United States Patent [19]

Katoh et al.

[11] 4,187,811

[45] Feb. 12, 1980

[54] EXHAUST GAS RECIRCULATION SYSTEM OF AN INTERNAL COMBUSTION ENGINE

[75] Inventors: Kenji Katoh; Tamotu Ogita, both of Susono, Japan

[73] Assignee: Toyota Jidosha Kogyo Kabushiki Kaisha, Toyota, Japan

[21] Appl. No.: 915,560

[22] Filed: Jun. 14, 1978

[30] Foreign Application Priority Data

Nov. 7, 1977 [JP] Japan ..... 52-132463

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,791,144 | 2/1974 | Lang | 123/119 A |
| 4,050,429 | 9/1977 | Yasuhiro et al. | 123/119 A |
| 4,112,894 | 9/1978 | Nohira | 123/119 A |
| 4,124,006 | 11/1978 | Rodenkirch | 123/119 A |
| 4,142,496 | 3/1979 | Saito et al. | 123/119 A |

*Primary Examiner*—Wendell E. Burns

*Attorney, Agent, or Firm*—Stevens, Davis, Miller & Mosher

[57] ABSTRACT

Disclosed is an exhaust gas recirculation system of an internal combustion engine for high altitude use. The system includes a feedback control valve for controlling the amount of exhaust gas fed back to an intake passage, and a compensating device for decreasing a set pressure level of the feedback control valve, above which set level the feedback control valve is caused to open so as to feed back the exhaust gas, when the atmospheric pressure level is lowered to less than a predetermined level. Thus, the amount of $NO_x$ formation contained in the exhaust gas can always be maintained at a low level and, furthermore, good operating characteristics of the engine can be obtained even when the engine is operated at high altitudes.

7 Claims, 4 Drawing Figures

EXHAUST GAS RECIRCULATION SYSTEM OF AN INTERNAL COMBUSTION ENGINE

BACKGROUND OF THE INVENTION

The present invention relates to an exhaust gas recirculation system (hereinafter referred to as an EGR system) of an internal combustion engine.

EGR systems, especially outer EGR systems, are well known as systems which can extract a part of the exhaust gas from an exhaust passage of the engine and feed the extracted exhaust gas into an intake passage located downstream or upstream of a throttle valve in an intake system of the engine via a special passage disposed outside of the engine, so as to reduce the $NO_x$ formation in the exhaust gas. A feedback control valve (hereinafter referred to as an EGR valve) for controlling the amount of the exhaust gas fed back to the intake passage is disposed on the special passage. Such EGR valve is generally controlled in accordance with the operating conditions of the engine, especially with the vacuum pressure level in a vacuum port opening into the intake passage at a position adjacent to the throttle valve. In this specification, this vacuum port is an EGR port which opens into the intake passage at a position located upstream of the throttle valve when the throttle valve is in the idling position and which opens into the intake passage located downstream of the throttle valve when the opening degree of the throttle valve exceeds a predetermined degree. Therefore, the actuating pressure level in the EGR port is maintained at the atmospheric pressure level when the throttle valve is in the idling position, and the actuating pressure level is rapidly changed into a high vacuum level when the opening degree of the throttle valve exceeds a predetermined degree. Then, the actuating pressure level in the EGR port gradually approaches to the atmospheric pressure level in accordance with the increasing opening degree of the throttle valve. The EGR valve is controlled so as to open when the absolute value of the vacuum pressure level in the EGR port exceeds a predetermined value. Accordingly, the exhaust gas recirculation is carried out only when the opening degree of the throttle valve is larger than a predetermined degree and the engine is in the low load operating condition.

However, when an engine, on which the above-mentioned exhaust gas recirculation system is mounted, is operating at high altitudes wherein the density of the air is reduced due to decreased atmospheric pressure, some problems in the operation of the engine will occur.

One problem is that a drop in the engine power generally occurs at high altitudes rather than at lower altitudes. To compensate the drop in the engine power, the throttle valve may be opened wider at higher altitudes than at lower altitudes. As a result, the pressure level of the vacuum fed from the EGR port to the EGR valve is lowered to a level corresponding to less than the predetermined value above which the EGR valve is caused to open. Therefore, the EGR valve is closed easily at high altitudes, and thus it becomes impossible to fully achieve the effect of reducing $NO_x$ formation in the exhaust gas.

Another problem is that an error in the ignition timing of the engine will occur at high altitudes. In a conventional engine, since the pressure of the vacuum fed to a vacuum advance device in an ignition system of the engine is decreased at high altitudes, the ignition timing at high altitudes is compensated to advance rather than retard the ignition timing at low altitudes. However, in this case, if the EGR valve is closed, namely, if exhaust gas recirculation control is not effected, at high altitudes as mentioned above, the ignition timing of the engine will be advanced too much. As a result, a drop in the engine power and also knocking in the engine will often occur.

SUMMARY OF THE INVENTION

It is, therefore, an object of the present invention to provide an exhaust gas recirculation system for an internal combustion engine, which can effectively reduce $NO_x$ formation contained in the exhaust gas.

Another object of the present invention is to provide an exhaust gas recirculation system which can attain good operating characteristics of the engine at high altitude.

According to the present invention, an exhaust gas recirculation system of an internal combustion engine comprises:

an exhaust gas feedback passage for feeding a part of the exhaust gas extracted from an exhaust passage of the engine to an intake passage of the engine;

a feedback control valve for controlling the amount of exhaust gas passing through the feedback passage, which feedback control valve is actuated so as to pass the exhaust gas therethrough when the absolute level of the vacuum pressure fed from a first vacuum port opening into the intake passage at a position adjacent to a throttle valve disposed in the intake passage exceeds a set level;

an atmospheric pressure sensing means for generating a pressure signal when the level of the atmospheric pressure is lowered to less than a predetermined level, and;

a correcting means for decreasing the above-mentioned set level for actuating the feedback control valve, in response to the pressure signal generated by the atmospheric pressure sensing means.

The above and other related objects and features of the present invention will become more apparent from the following description of the present invention with reference to the accompanying drawings, and also from the appended claims.

DETAILED DESCRIPTION OF THE INVENTION

Figure 1:
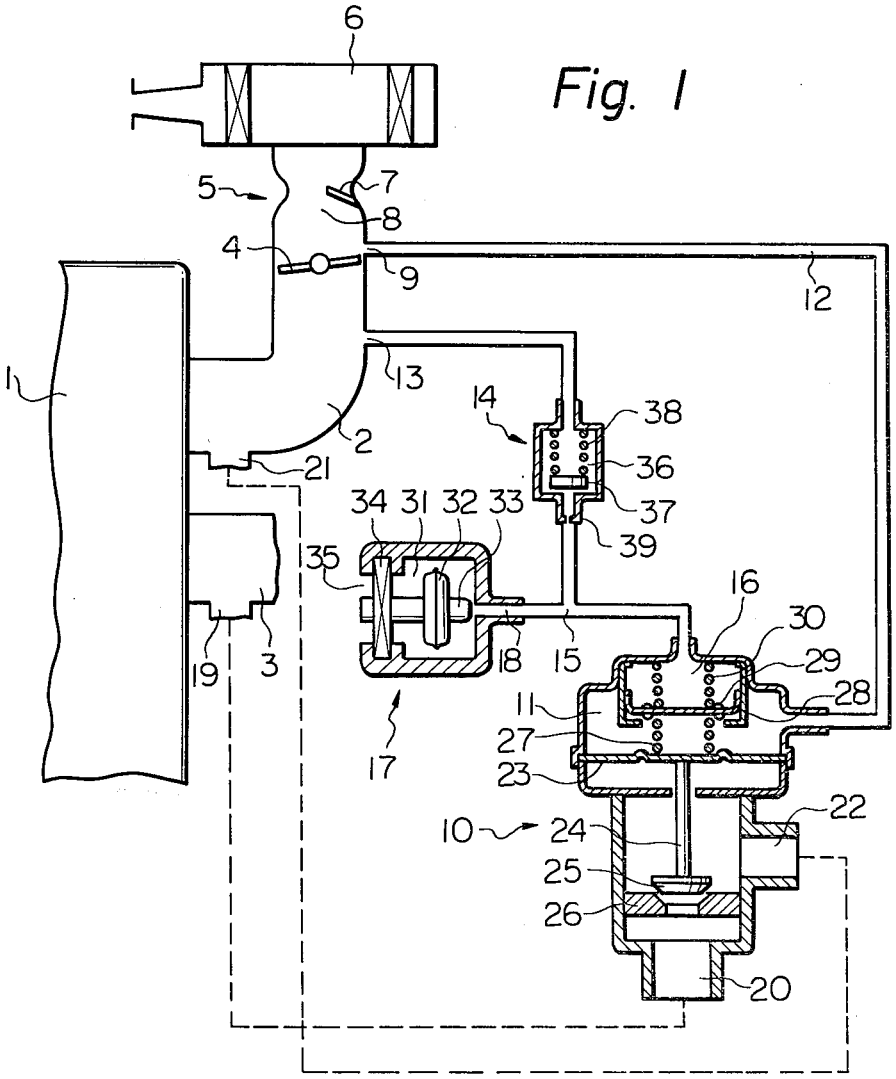
FIG. 1 is a schematic view which shows one embodiment according to the present invention.

Referring to FIG. 1 which illustrates an embodiment according to the present invention, reference numeral 1 represents an engine body, 2 an intake manifold, and 3 an exhaust manifold. A carburetor 5 with a throttle valve mounted therein is disposed upstream of the intake manifold 2. An air cleaner 6 is disposed upstream of the carburetor 5. Reference numeral 8 represents an intake passage, 7 a fuel nozzle for feeding fuel into the intake passage 8, and 9 an EGR port which is similar to the aforementioned EGR port. The EGR port 9 is communicated with a diaphragm control chamber 11 of an EGR valve 10, which is similar to the aforementioned EGR valve, via a vacuum passage 12. A port 13, which is opened into the intake manifold 2, is constructed so as to be connectable to a correcting chamber 16 disposed in the EGR valve 10 via a check valve 14 and via a vacuum passage 15. A port 18 of an atmospheric pressure sensing valve 17 is communicated with the vacuum passage 15. An inlet port 20 of the EGR valve 10 is communicated with the exhaust manifold 3 via a port 19, and an outlet port 22 of the EGR valve 10 is communicated with the intake manifold 2 via a port 21.

The EGR valve 10 further comprises a diaphragm 23 for forming the aforementioned diaphragm control chamber 11, a valve member 25 connected to the diaphragm 23 through a valve rod 24, and a valve seat 26 on which the valve member 25 can rest. Since the diaphragm 23 is always pressed downwards in the downward direction of FIG. 1 by a first spring 27, when the pressure level in the diaphragm control chamber 11 becomes equal to the atmospheric pressure level, the valve member 25 is thus caused to rest on the valve seat. As a result, the inlet port 20 is cut off from the outlet port 22, namely, the EGR valve 10 is closed.

When the vacuum pressure is applied to the diaphragm control chamber 11 and when the attracting force caused by the vacuum pressure surpasses a pressing force caused by the first spring 27, in other words, when the absolute level of the vacuum pressure fed from the EGR port 9 to the diaphragm control chamber 11 exceeds a set level which is determined by the pressing force caused by the first spring 27, the valve member 25 moves toward the upper side of FIG. 1. As a result, the inlet port 20 communicates with the outlet port 22 via the valve seat 26 which is also operating as an orifice.

The correcting chamber 16 is provided with a cylindrical chamber 28 which is communicated with the vacuum passage 15, and a movable disk 29 which is slidable closely along the inner wall of the cylindrical chamber 28. This movable disk 29 always receives pressing forces caused by the first spring 27 and a second spring 30. One pressing force caused by the first spring 27 is a force directed toward the upper side of FIG. 1 and the other pressing force caused by the second spring 30 is a force directed toward the lower side of FIG. 1. When the vacuum pressure is applied to the correcting chamber 16, since the movable disk 29 receives an attracting force and is thus moved upwards, the first spring 27 is caused to expand. As a result, the pressing force caused by the first spring 27 against the diaphragm 23 is reduced, and accordingly, the above-mentioned set level of the vacuum pressure in the diaphragm control chamber 11, which set level indicates a minimum level of the vacuum pressure for opening the EGR valve 10, is decreased.

The atmospheric pressure sensing valve 17 is provided with a chamber 31 opened to the atmosphere through an air cleaner 34 and through a port 35, an aneroid bellows 32 in which a specific gas is sealed and which is disposed in the chamber 31, and a plunger 33 connected to the bellows 32. At high altitudes, the bellows 32 will expand, in accordance with the decreasing atmospheric pressure so as to press the plunger 33 in a direction toward the right side of FIG. 1. As a result, the chamber 31 is cut off from the port 18. At low altitudes, the atmospheric pressure is so high that the bellows 32 does not expand. Therefore, as shown in FIG. 1, the port 18 is connected to the chamber 31 and opened to the atmosphere.

The check valve 14 is provided so as to maintain the level of the vacuum pressure in the vacuum passage 15 at a constant level during the closing of the valve 17. When a pressing force, which is caused by a spring 38 disposed in a chamber 36 of the check valve 14 and which affects a valve member 27 also disposed in the chamber 36, exceeds the attracting force caused by the vacuum pressure applied to the chamber 36 via the port 13 from the intake manifold 2, the chamber 36 is cut off from the passage 15. Therefore, the level of the vacuum pressure in the passage 15 is kept constant during the closing of the valve 17 even when the vacuum pressure level in the intake manifold 2 approaches that of atmospheric pressure. The check valve 14 is further provided with an orifice 39 for preventing an air flow from occurring via the valve 17, the passage 15 and the port 13 during opening of the valve 17.

The operation of the system of the present embodiment will now be described.

The operation of the system occurring when the engine is operating at low altitudes will be explained first hereinafter. In this case, since the atmospheric pressure sensing valve 17 is being opened and the atmospheric pressure is thus fed into the correcting chamber 16 of the EGR valve 10, the movable disk 29 is positioned at the lower end portion of the cylindrical chamber 28 due to the pressing force caused by the second spring 30. Therefore, the pressing force applied to the diaphragm 23 by the first spring 27 is maintained at a predetermined initial level, and the EGR valve 10 is caused to operate similarly as the conventional EGR valve.

More specifically, the EGR valve 10 is closed when the throttle valve 4 is in the idling position. Thereafter, the EGR valve is opened so as to feed back a part of the exhaust gas in the exhaust manifold 3 to the intake manifold 2 when the opening degree of the throttle valve 4 exceeds a predetermined degree. When the opening degree of the throttle valve 4 becomes wider and the engine is in a high load operating condition, the absolute value of the vacuum pressure level is in the diaphragm control chamber 11 is lowered to less than a set level determined by the pressing force of the first spring 27, and then the EGR valve 10 is closed. As a result, recirculation of the exhaust gas is stopped.

The operation of the system of the present embodiment occurring when the engine is operating at high altitudes is illustrated hereinafter. In this case, since the valve 17 is closed due to the decrease of the atmospheric pressure, and furthermore, since both of the vacuum passage 15 and the correcting chamber 16 of the EGR valve 10 are filled with the vacuum having a constant pressure level, the movable disk 29 moves to the upper end portion of the cylindrical chamber 28 thus causing the first spring 27 to expand. As a result, the set level of the vacuum pressure, above which the EGR valve 10 is caused to open, is lowered.

The EGR valve 10 according to the present embodiment, therefore, can be kept open so as to recirculate the exhaust gas during high altitude conditions, even when the engine is operating under a high load condition, and the absolute level of the vacuum pressure in the diaphragm control chamber 11 is lowered to less than a set pressure level, below which the EGR valve 10 is caused to close at lower altitudes. In other words, according to the present embodiment, the operating region within which recirculation of the exhaust gas is carried out is enlarged at high altitudes rather than at lower altitudes.

Figure 2:
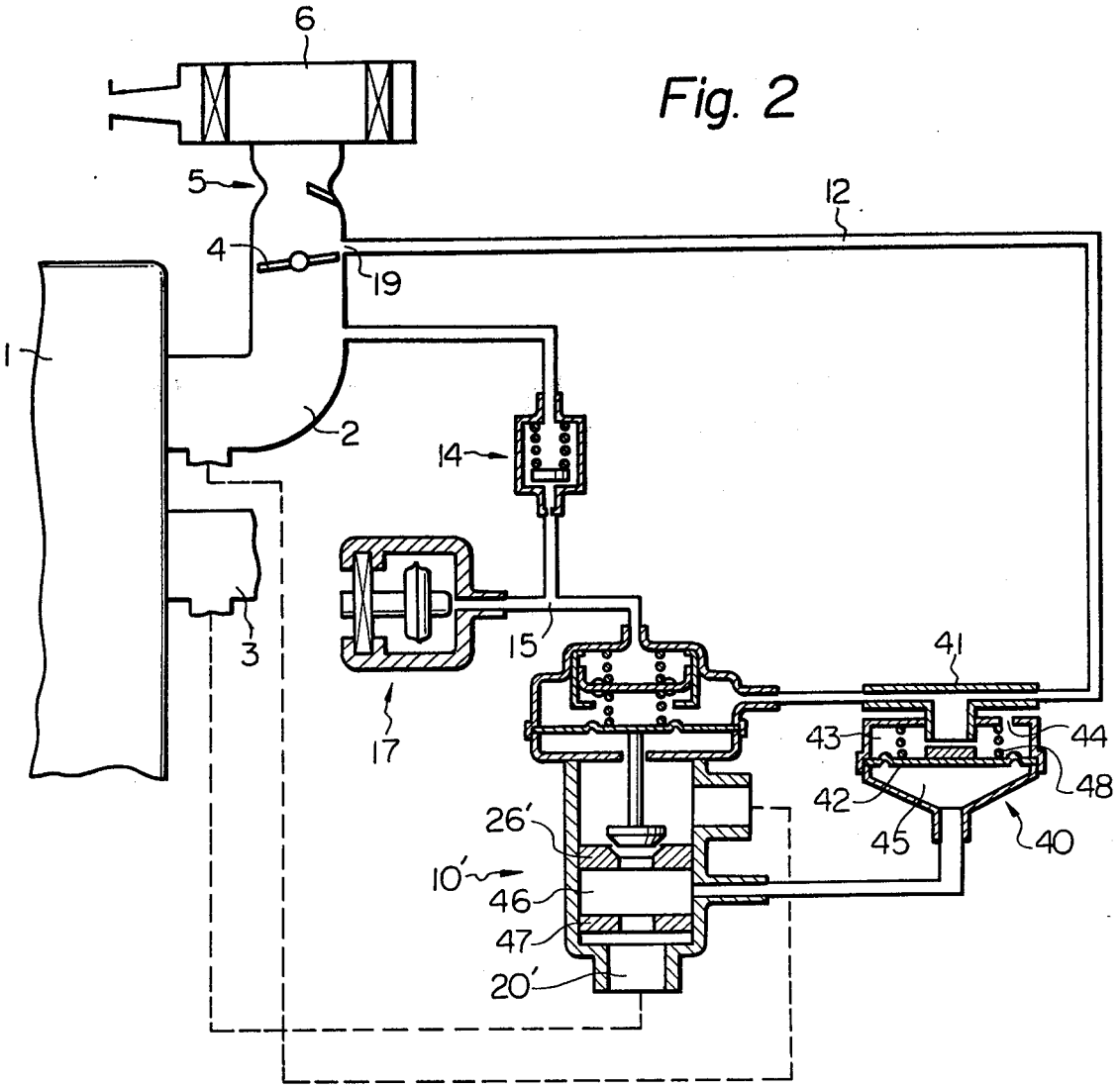
FIG. 2 is a schematic view which shows another embodiment according to the present invention.

FIG. 2 illustrates another embodiment according to the present invention. An EGR system of the back pressure control type is adapted in this embodiment. Such EGR system is well known as a system for controlling recirculation of the exhaust gas by using the pressure caused by the exhaust gas (back pressure) so as to feed back a certain amount of exhaust gas to the intake passage, which amount being proportional to the amount of air taken into the engine.

As shown in FIG. 2, the difference between the aforementioned EGR system and this EGR system is as follows. As shown in FIG. 2, an EGR valve 10' instead of the EGR valve 10 (FIG. 1) is mounted in this EGR system, and a back pressure transducer valve 40 (hereinafter referred to as a BPT valve) is disposed on the vacuum passage 12. The BPT valve 40 is provided with a chamber 41 which is communicated with the passage 12, a diaphragm 42 and a chamber 43. The chamber 43 is connectable to the chamber 41 in response to the operation of the diaphragm 42 opened to the atmosphere through a port 44. The EGR valve 10' is provided with a pressure control chamber 46 and an orifice 47 both located between a valve seat 26', which also operates as an orifice, and an inlet port 20'. This pressure control chamber 46 is communicated with a diaphragm control chamber 45 of the BPT valve 40.

When the pressure level in the diaphragm control chamber 45 of the BPT valve 40 exceeds a predetermined level attained due to the pressing force caused by a spring 48, the diaphragm 42 is lifted and the chamber 41 is cut off from the chamber 43. As a result, the vacuum pressure fed from the EGR port 19 via the passage 12 is applied to the EGR valve 10' without any change in the pressure level. When the pressure level in the chamber 45 of the BPT valve 40 is lowered to less than above-mentioned predetermined level, the diaphragm 42 is moved downwards in the downward direction of FIG. 2 due to the pressing force caused by the spring 48. As a result, the atmospheric pressure is applied to the chamber 41 via the port 44 and the chamber 43. As a result, the absolute level of the vacuum pressure which is fed into the EGR valve 10' is reduced thus causing the EGR valve 10' to close.

As is described above, according to this EGR system, the pressure level in the pressure control chamber 46 is controlled to be constant so that the amount of the exhaust gas fed back to the intake passage due to the recirculation control of the exhaust gas is kept constant.

The operation and effect of the present embodiment are the same as those of the aforementioned embodiment of FIG. 1.

Figure 3:
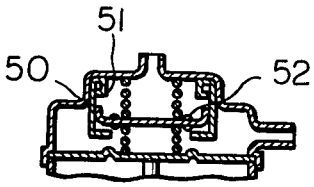
FIG. 3 is a cross-sectional view of an alternate embodiment of an EGR valve.

FIG. 3 illustrates a part of the construction of another variation of the EGR valves 10 and 10' shown in FIGS. 1 and 2, respectively. As shown in FIG. 3, this EGR valve has a stopper 51 disposed at a position of the upper end portion of the inner wall of a cylindrical chamber 50 which is similar to the cylindrical chamber 28 of FIGS. 1 and 2. The stopper 51 is adapted for the purpose of preventing a movable disk 52, which is similar to the movable disk 29 of FIGS. 1 and 2, from moving upwards above a predetermined position. Accordingly, a set level of the vacuum pressure, above which the EGR valve is caused to open, is not lowered to less than a predetermined level corresponding to a position where the stopper 51 is mounted. Therefore, the above-mentioned set level for opening the EGR valve during high altitudes can be desirably determined.

Figure 4:
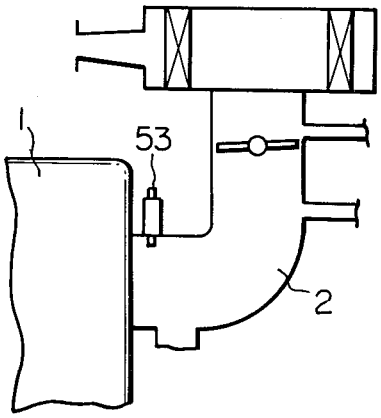
FIG. 4 is a cross-sectional view of an alternate embodiment of an engine body.

In the foregoing embodiments, engines having a carburetor for supplying fuel thereto are used. However, in some embodiments of the present invention, engines having a fuel injection valve 53 for supplying fuel into the intake manifold 2 may be used instead, as is shown in FIG. 4.

As will be apparent from the foregoing illustrations, the exhaust gas recirculation system according to the present invention comprises an atmospheric pressure sensing means for generating a pressure signal when the level of the atmospheric pressure is lowered to less than a predetermined level, and a correcting means for decreasing a set pressure level of the EGR valve, above which set level the EGR valve is caused to open, when the above-mentioned pressure signal is applied thereto. Therefore, $NO_x$ formation in the exhaust gas can always be effectively reduced, and furthermore, good operating characteristics of the engine can be obtained even when the engine is operated a high altitudes, according to the present invention.

As many widely different embodiments of the present invention may be constructed without departing from the spirit and scope of the present invention, it should be understood that the present invention is not limited to the specific embodiments described in this specification, except as defined in the appended claims.

What is claimed is:

1. An exhaust gas recirculation system of an internal combustion engine having an intake passage, an exhaust passage and a throttle valve disposed in said intake passage, comprising:

an exhaust gas feedback passage for feeding a part of the exhaust gas extracted from said exhaust passage to said intake passage;

a feedback control valve for controlling the amount of the exhaust gas passing through said feedback passage, said feedback control valve being actuated so as to pass the exhaust gas therethrough when the absolute level of the vacuum pressure fed from a first vacuum port opening into said intake passage at a position adjacent to said throttle valve exceeds a set level;

an atmospheric pressure sensing means for generating a pressure signal when the level of the atmospheric pressure is lowered to less than a predetermined level, and;

a correcting means for decreasing said set level for actuating said feedback control valve, in response to said pressure signal generated by said atmospheric pressure sensing means.

2. An exhaust gas recirculation system of an internal combustion engine as claimed in claim 1, wherein said feedback control valve comprises an inlet port communicated with said exhaust passage through a part of said feedback passage, an outlet port communicated with said intake passage through a part of said feedback passage, a valve seat and a valve member both of which are disposed between said inlet port and said outlet port, a diaphragm connected to said valve member, a diaphragm-control chamber communicated with said first vacuum port, and a diaphragm-return spring for effecting a force corresponding to said set level to said diaphragm.

3. An exhaust gas recirculation system of an internal combustion engine as claimed in claim 2, wherein said correcting means is composed of a correcting chamber disposed in said feedback control valve so as to correct said force effected by said return spring.

4. An exhaust gas recirculation system of an internal combustion engine as claimed in claim 3, wherein said correcting chamber comprises a cylindrical chamber communicated with said atmospheric pressure sensing means, a movable disk which can slide closely along the inner wall of said cylindrical chamber and a pressing spring for pressing said movable disk toward the outside of said cylindrical chamber, said movable disk for receiving both the force caused by said pressing spring and the force caused by said return spring.

5. An exhaust gas recirculation system of an internal combustion engine as claimed in claim 1 or 4, wherein said atmospheric pressure sensing means comprises a vacuum passage which is always communicated with a second vacuum port opening into said intake passage at a position located downstream of said throttle valve through a check valve for preventing the occurrence of a reverse vacuum flow, and an atmospheric pressure sensing valve which is always communicated with said vacuum passage and closed to the atmosphere where the atmospheric pressure level is lower than said predetermined level.

6. An exhaust gas recirculation system of an internal combustion engine as claimed in claim 1, wherein said system further comprises means for controlling the amount of exhaust gas passing through said feedback control valve in proportion to the amount of air introduced into said intake passage.

7. An exhaust gas recirculation system of an internal combustion engine as claimed in claim 1 or 6, wherein said correcting means includes a stopper means for preventing said set level from being lowered to below a predetermined level.

* * * * *